US006813891B2

(12) United States Patent
Heron et al.

(10) Patent No.: US 6,813,891 B2
(45) Date of Patent: Nov. 9, 2004

(54) PULSE TUBE REFRIGERATOR

(75) Inventors: Roger Artindale Heron, Stagsden (GB); Peter Derek Daniels, Daventry (GB); David Michael Crowley, Marlow Bottom (GB)

(73) Assignee: Oxford Magnet Technology Limited, Oxford (GB)

( * ) Notice: Subject to any disclaimer, the term of this patent is extended or adjusted under 35 U.S.C. 154(b) by 0 days.

(21) Appl. No.: 10/315,224

(22) Filed: Dec. 10, 2002

(65) Prior Publication Data

US 2003/0200755 A1 Oct. 30, 2003

(30) Foreign Application Priority Data

Dec. 11, 2001 (GB) ..... 0129514

(51) Int. Cl.[7] ..... F25B 9/00; F25D 19/00
(52) U.S. Cl. ..... 62/6; 62/298
(58) Field of Search ..... 62/6, 298

(56) References Cited

U.S. PATENT DOCUMENTS 4,475,345 A 10/1984 Forth et al.
4,956,974 A * 9/1990 Planchard et al. ..... 62/6
4,995,237 A 2/1991 Strasser
5,385,010 A * 1/1995 Horn ..... 62/6
5,711,157 A * 1/1998 Ohtani et al. ..... 62/6
6,308,520 B1 * 10/2001 Inoue et al. ..... 62/6
6,536,218 B1 * 3/2003 Steinmeyer ..... 62/6

FOREIGN PATENT DOCUMENTS

EP 1 087 195 A2 3/2001
EP 1 158 256 A2 11/2001
GB 2 249 620 A 5/1992
JP 2001-289527 10/2001

* cited by examiner

*Primary Examiner*—William C. Doerrler
(74) *Attorney, Agent, or Firm*—Crowell & Moring LLP

(57) ABSTRACT

A pulse tube refrigerator comprises a fixed pressure casing (3) containing cold parts and a removable pressure casing (2) containing serviceable parts. The fixed pressure casing (3) and the removable pressure casing (2) are coupled together via a joining member (1). During cooling operation the joining member (1) is arranged such that refrigerant fluid flows between the fixed and the removable casings. During servicing the joining member is arranged to cut off flow of refrigerant fluid between the fixed and removable casings, such that refrigerant in the fixed casing is trapped and parts in the removable casing are accessible for servicing. After servicing, substantially pure refrigerant fluid is pumped into the removable casing (2), the fixed and removable casings are re-joined and the joining member (1) is arranged such that refrigerant fluid flows between the casings again.

7 Claims, 1 Drawing Sheet

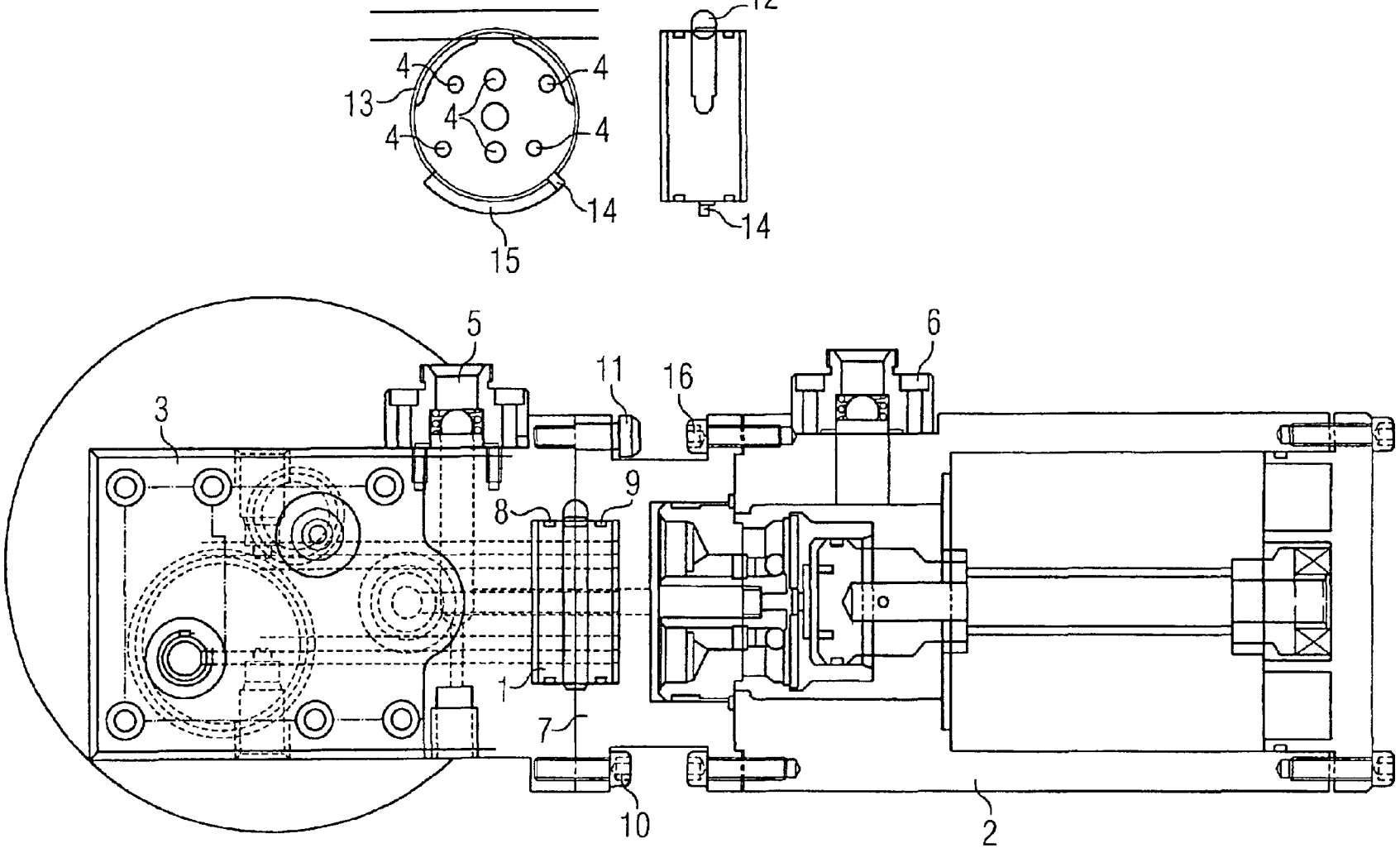
12
14
4
4
14
15
4
4
4
13
6
16
11
9
8
5
3
2
10
7
1

PULSE TUBE REFRIGERATOR

Cryocoolers are often used for cryogenic cooling of large superconducting magnet systems, used for MRI, NMR, research or large-scale industrial applications like magnetic separation. They are used either as shield cooling devices to reduce heating of the magnet which can be contained in a liquid, typically helium, or in a vacuum. Pulse Tube Refrigerators (PTR's) have recently become commercially available with cooling powers in the required range for the applications mentioned above. These cryocoolers can now be considered for use in these systems. A PTR is a type of cryocooler which has no moving cold parts. Potentially this type of cryocooler offers lower service costs and significantly lower vibration signatures than other commercial alternatives like Gifford McMahon (GM), GM/Joule Thompson (JT) or Stirling cycle cryocoolers.

When cryocoolers of any type are used to cool large superconducting magnet systems for the applications described above, they are required to be extremely reliable and be serviced with the minimum interruption to the application or process. One factor affecting the long term reliability of all cryocoolers is the purity of the working refrigerant fluid, in this case helium gas. During the service operation the cryocooler system has to be opened up to replace serviceable parts and there must be no ingress into the system of any contaminant gas including, for example, air. In ideal conditions the PTR would be serviced with the cryocooler cold stages at cryogenic temperature. Thus if the part containing the cold stages is opened to air in the service operation, air and other contaminants will cryopump and become trapped onto the cold stages inside the machine. Normally this makes the PTR inoperable without warming the cold parts to room temperature and purging the air from the system with helium gas.

In accordance with the present invention, a pulse tube refrigerator comprises a fixed pressure casing containing cold parts and a removable pressure casing containing serviceable parts; wherein the fixed pressure casing and the removable pressure casing are coupled together via a joining member; wherein during cooling operation the joining member is arranged such that refrigerant fluid flows between the fixed and the removable casings; wherein during servicing the joining member is arranged to cut off flow of refrigerant fluid between the fixed and removable casings, such that refrigerant in the fixed casing is trapped and parts in the removable casing are accessible for servicing; wherein after servicing, substantially pure refrigerant fluid is pumped into the removable casing; the fixed and removable casings are re-joined and the joining member is arranged such that refrigerant fluid flows between the casings again.

The present invention allows a cryocooler system incorporating a pulse tube refrigerator to be opened up and serviced such that no air or contaminant gasses are admitted to the cold parts of the system. The cold parts are kept at cryogenic temperature without affecting the future performance of the system by degrading the purity of the refrigerant fluid.

The removable casing could be directly connected to the fixed casing, with the joining member comprising a seal between them, but preferably, the joining member comprises a clamp section and a seal.

This has the advantage that the clamp section can be allowed to move far enough from the fixed casing to allow the seal to be correctly positioned to cut of fluid flow, without opening up the serviceable parts until the cold parts are properly sealed off.

Preferably, the seal comprises a rotatable disc.

Provided that the disc is able to seal off the flow passages for closure, the size of the apertures is not constrained, but preferably, the rotatable disc is provided with apertures having substantially the same cross section as that of flow passages between the fixed and removable casings.

Preferably, the clamp section is provided with clamping means adapted to limit the extent of movement of the joining member away from the fixed casing.

This reduces the likelihood of contaminated gas entering the cold parts.

Preferably the removable casing is detached from the clamp section to allow access for servicing.

An example of a pulse tube refrigerator according to the present invention will now be described with reference to the accompanying drawing in which:—

FIG. 1 illustrates a pulse tube refrigerator according to the present invention.

A pulse tube refrigerator (PTR) comprises serviceable items housed in a removable pressure casing 2 and cold parts contained in a fixed pressure casing 3. The fixed and removable casings are joined together and a seal is provided between them. This seal would be open during normal operation and closed for servicing. In this example, the seal is formed by a rotatable disc 1 positioned between the removable pressure casing and the fixed pressure casing. In normal operation the disc is positioned such that apertures in the disc align with flow passages between the cold parts and serviceable parts, so that all passages are clear for the flow of refrigerant fluid essential to the operation of the PTR. Sealing of ports is achieved at the ends of the disk 1 by either a flexible gasket 4 or a series of O ring seals (not shown) one for each flow passage.

When it is desired to service items in the removable pressure casing 2, the cold items in the fixed pressure casing 3 are sealed off by rotating the disc 1 until the flow passages are blocked. In order for the disc 1 to be rotated the PTR must be stopped and the refrigerant supply connections 5, 6 disconnected. These connections are self-sealing and do not permit any ingress of air contaminant gas. A clamp piece 7 clamps the rotatable disc in place between the fixed and removable casings. To allow the disc to be rotated, screws 10 retaining the clamp piece 7 are removed in a controlled sequence. Removal of the screws 10 frees the clamp piece 7 and removable pressure casing 2, as a unit, to move away from the fixed pressure casing 3. The motion is caused by action of internal pressure. Refrigerant fluid is retained in the assembly by O ring seals 8, 9 on the rotatable disc. Shoulder bolts 11, which restrict the motion of the clamp piece 7 and removable pressure casing 2, prevent the parts from opening up completely.

The rotatable disc 1 is then rotated by action of a worm 12 on a wheel drive mechanism 13. The worm 12 is retained in the clamp piece 7. The motion of the rotatable disc 1 is limited by a positive mechanical stop. In the FIG. 1 a pin 14 is shown, stopped at the ends of a machined groove 15. One position is for open and another position is for closed or sealed, in terms of flow through the rotatable disc 1. Sealing off the parts of the PTR is completed by replacing the screws 10, so that the fixed pressure casing 3 is completely sealed off from the removable pressure casing 2. The serviceable parts of the removable pressure casing can now be accessed safely by opening the casing at bolts 16. Once the serviceable parts have been replaced the bolts 16 are re-fitted to the removable pressure casing 2. The refrigerant gas spaces in the removable pressure casing 2 are pumped out and replaced by pure refrigerant gas, which removes all air and contaminant gasses from the removable pressure casing 2. The fixed and removable casings are then rejoined and the rotatable disc is rotated back into position to allow fluid flow by reversing the steps described above.

What is claimed is:

1. A pulse tube refrigerator, comprising:

a fixed pressure casing containing cold parts; and a removable pressure casing containing serviceable parts; wherein the fixed pressure casing and the removable pressure casing are coupled together via a joining member;

during cooling operation the joining member is arranged such that refrigerant fluid flows between the fixed and the removable casings;

during servicing the joining member is arranged to cut off flow of refrigerant fluid between the fixed and removable casings by rotation of apertures in a seal between the casings, such that refrigerant in the fixed casing is trapped and parts in the removable casing are accessible for servicing; and after servicing, substantially pure refrigerant fluid is pumped into the removable casing, the fixed and removable casings are re-joined and the joining member is arranged such that refrigerant fluid flows beween the casings again.

2. A pulse tube refrigerator, the refrigerator comprising a fixed pressure casing containing cold parts and a removable pressure casing containing serviceable part; wherein the fixed pressure casing and the removable pressure casing are coupled together via a joining member; wherein during cooling operation the joining member is arranged such that refrigerant fluid flows between the fixed and the removable casings; wherein during servcing the joining member is arranged to cut off flows of refrigerant fluid between the fixed and removeable casings such that refrigerant in the fixed casing is trapped and parts in the removable casing are accessible for servcing; wherein after servcing, substantially pure refrigerant fluid is pumped into the removable casing; the fixed and removable casing are re-joined and the joining member is arranged such that refrigerant fluid flows between the casing again; and wherein the joining member comprises a clamp section and a seal.

3. A pulse tube refrigerator according to claim 2, wherein the seal comprises a rotatable disc.

4. A pulse tube refrigerator according to claim 3, wherein the rotatable disc is provided with apertures having substantially the same cross section as that of flow passages the fixed and removable casings.

5. A pulse tube refrigerator according to at least claim 2 wherein the clamp section is provided with clamping means adapted to limit the extent of movement of the joining member away from the fixed casing.

6. A pulse tube refrigerator according to claim 1, wherein the removable casing is detached from a clamp section to allow access for servicing.

7. A pulse tube refrigerator, comprising:

a fixed pressure casing containing cold parts;

a removable pressure casing containing serviceable parts, said removable pressure casing being detachably connected to said fixed pressure casing and having an interior space that is fluidically connectable to an interior space of said fixed pressure casing using via refrigerant flow passages to permit cooling operation of said refrigerator, a seal member disposed between said fixed pressure casing and said removable pressure casing and said removable pressure casing and having apertures therein, said seal member being rotatable between a first position in which said apertures align with said refrigerant flow passages permitting refrigerant flow between said interior of said removable pressure casing and said interior of said fixed pressure using via said flow passages during cooling operation of said refrigerator and a second position in which said apertures do not align with said flow passages, thereby interrupting said refrigerant flow during servicing of said refrigerator.

* * * * *